US006231926B1

(12) United States Patent
Ronzani et al.

(10) Patent No.: US 6,231,926 B1
(45) Date of Patent: May 15, 2001

(54) POROMERIC SYNTHETIC LEATHERS

(75) Inventors: Cesare Ronzani, Ludwigshafen; Ralf Mossbach, Lambrecht; Karl Häberle, Speyer, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/325,798

(22) Filed: Jun. 4, 1999

(30) Foreign Application Priority Data

Jun. 6, 1998 (DE) ..... 198 25 453

(51) Int. Cl.[7] ..... B05D 3/10

(52) U.S. Cl. ..... 427/341; 427/342; 427/353; 427/354; 427/389.9; 428/423.7; 521/61; 521/63; 521/92; 521/93; 521/94; 521/97; 524/591; 524/839; 524/840; 525/123; 525/129; 525/130; 525/131; 525/453; 525/460; 528/71; 528/488; 528/489; 528/492

(58) Field of Search ..... 521/94, 97, 92, 521/93, 61, 63; 524/839, 840, 591; 525/123, 129, 130, 131, 453, 460; 528/71, 489, 492, 488; 428/423.7; 427/341, 342, 353, 354, 389.9

(56) References Cited

FOREIGN PATENT DOCUMENTS 53-028773 * 3/1978 (JP) .
53-062804 * 6/1978 (JP) .
54-101403 * 8/1979 (JP) .

OTHER PUBLICATIONS

Chemical Abstract, Accession No. 127: 150058e, JP 09, 188, 975, Jul. 22, 1997.
Kunststoff Handbuch Band 7: Polyurethane, pp. 446–447. Carl Hanser Verlag München Wien, 3. Auflage 1993 (with partial English Translation).

* cited by examiner

*Primary Examiner*—Erma Cameron
(74) *Attorney, Agent, or Firm*—Oblon, Spivak, McClelland, Maier & Neustadt, P.C.

(57) ABSTRACT

A process for producing poromeric synthetic leather comprises

I. producing an essentially nonporous impregnate by impregnating a textile sheet material with an aqueous polyurethane dispersion and drying, and II. producing a poromeric synthetic leather from the impregnate by subjecting the impregnate to the action of an aqueous solution of a Brønsted base.

20 Claims, No Drawings

POROMERIC SYNTHETIC LEATHERS

BACKGROUND OF THE INVENTION

1. Field of the Invention

The present invention relates to a process for producing poromeric synthetic leather, which comprises:

I. producing an essentially nonporous impregnate by impregnating a textile sheet material with an aqueous polyurethane dispersion and drying, and II. producing a poromeric synthetic leather from the impregnate by subjecting the impregnate to the action of an aqueous solution of a Brønsted base. The present invention further relates to these poromeric synthetic leathers themselves.

2. Description of the Background

Poromeric synthetic leathers should in their property spectrum come very close to that of high grade natural leather varieties, especially suede leather. This applies particularly to properties such as good water vapor permeability, a high tear strength and pleasant haptic properties.

The production of poromeric synthetic leather is common knowledge (cf. Kunststoffhandbuch, Carl Hanser Verlag, Munich, Vienna, vol. 7:*Polyurethane,* 3rd edition 1993, chapter 10.2.1.4). Prior art processes all produce their synthetic leathers from solutions or dispersions of polyurethanes which contain organic solvents. For example, in the coagulation process, a textile sheet material is impregnated with an organic solution of a polyurethane, optionally in a mixture with a polyurethane dispersion and optionally a polyelectrolyte, and the sheet material thus pretreated is then passed successively through a plurality of baths comprising mixtures of dimethylformamide and water with decreasing dimethylformamide concentration.

One variant of this process, which leads to textile articles having a particularly pleasant, leatherlike hand, is described in JP 09/18 89 75. A polyester web is impregnated with a solution of a thermoplastic polyurethane in DMF/toluene and then treated with aqueous sodium hydroxide solution. The synthetic leather obtained possesses the flexibility of natural leather.

The disadvantage with these processes is that they produce large quantities of waste air or water which contain organic solvents and have to be worked up in a complicated manner.

SUMMARY OF THE INVENTION

It is an object of the present invention to provide poromeric synthetic leathers which, with regard to their performance characteristics, differ as little as possible from natural leather varieties and are simpler to produce than prior art poromeric synthetic leathers.

We have found that this object is achieved by the poromeric synthetic leathers described at the beginning and by the processes for producing them.

DETAILED DESCRIPTION OF THE PREFERRED EMBODIMENTS

The poromeric synthetic leathers are produced using textile sheet materials comprising woven or nonwoven textiles having a basis weight of from 100 to 1000 g/m$^2$, particularly preferably from 250 to 500 g/m$^2$.

Suitable materials for producing the textile sheet materials are especially the customary fiber-forming polymers, for example polyamides, polyurethanes, polypropylene, polyethylene, polyacrylonitrile and particularly preferably polyesters. It is also possible to use natural fibers such as, for example, wool, cotton, viscose or silk.

For the purposes of this invention, polyesters are preferably polyethylene terephthalate, polytetramethylene terephthalate or poly(1,4-cyclohexanedimethylene terephthalate).

Very particular preference is given to nonwoven polyester fabrics, which may be needled.

Such fibers are common knowledge and described for example in Ullmann's Encyclopedia of Industrial Chemistry, VCH Verlagsgesellschaft mbH, D-6940 Weinheim, fifth edition, Volume A 10, Fibers, 4.

The impregnants used for producing the impregnates are polyurethane dispersions. Suitable polyurethane dispersions are common knowledge and described for example in Kunststoffhandbuch, Carl Hanser Verlag, Munich, Vienna, vol. 7:*Polyurethane,* 3$^{rd}$ edition 1993, chapter 2.3.3. As well as polyurethane dispersions containing polyurethanes dispersed with the aid of emulsifiers or protective colloids, it is possible to use in particular self-dispersible polyurethanes whose self-dispersibility is obtained through the incorporation of ionically or nonionically hydrophilic groups. The latter are preferably polymerized from a1) diisocyanates having from 4 to 30 carbon atoms, a2) diols, of which a2.1) from 10 to 100 mol %, based on total diols (a2), have a molecular weight from 500 to 5000, and a2.2) from 0 to 90 mol %, based on total diols (a2), have a molecular weight from 60 to 500 g/mol, a3) monomers, other than monomers (a1) and (a2), which bear at least one isocyanate group or at least one isocyanate reactive group and which in addition bear at least one hydrophilic group or a potentially hydrophilic group to render the polyurethanes water-dispersible, a4) optionally further polyfunctional compounds, other than monomers (a1) to (a3), having reactive groups comprising alcoholic hydroxyl groups, primary or secondary amino groups or isocyanate groups, and a5) optionally monofunctional compounds, other than monomers (a1) to (a4), having a reactive group comprising an alcoholic hydroxyl group, a primary or secondary amino group or an isocyanate group.

Suitable monomers (a1) include the diisocyanates customarily used in polyurethane chemistry.

Diisocyanates $X(NCO)_2$, where X is an aliphatic hydrocarbon radical having 4 to 12 carbon atoms, a cycloaliphatic or aromatic hydrocarbon radical having from 6 to 15 carbon atoms or an araliphatic hydrocarbon radical having from 7 to 15 carbon atoms, are particularly suitable. Examples of such diisocyanates are tetramethylene diisocyanate, hexamethylene diisocyanate, dodecamethylene diisocyanate, 1,4-diisocyanatocyclohexane, 1-isocyanato-3,5,5-trimethyl-5-isocyanatomethylcyclohexane (IPDI), 2,2-bis(4-isocyanatocyclohexyl)propane, trimethylhexane diisocyanate, 1,4-diisocyanatobenzene, 2,4-diisocyanatotoluene, 2,6-diisocyanatotoluene, 4,4'-diisocyanatodiphenylmethane, 2,4'-diisocyanatodiphenylmethane, p-xylylene diisocyanate, tetramethylxylylene diisocyanate (TMXDI), the isomers of bis(4-isocyanatocyclohexyl)methane (HMDI) and also mixtures thereof.

Particularly important mixtures of these isocyanates are mixtures of the respective structural isomers of diisocyanatotoluene and diisocyanatodiphenylmethane, especially the mixture of 80 mol % of 2,4-diisocyanatotoluene and 20 mol % of 2,6-diisocyanatotoluene. Also of particular advantage are the mixtures of aromatic isocyanates such as 2,4-diisocyanatotoluene and/or 2,6-diisocyanatotoluene with aliphatic or cycloaliphatic isocyanates such as hexamethylene diisocyanate and IPDI, the preferred mixing ratio of the aliphatic to aromatic isocyanates being within the range 4:1 to 1:4.

With regard to good filming and elasticity, diols (a2) are chiefly higher molecular weight diols (a2.1) which have a molecular weight from about 500 to 5000, preferably from about 1000 to 3000, g/mol.

The diols (a2.1) are especially polyesterpolyols which are known for example from Ullmanns Encyklopäidie der technischen Chemie, $4^{th}$ edition, volume 19, pages 62 to 65. Preference is given to using polyesterpolyols obtained by reaction of dihydric alcohols with dibasic carboxylic acids. Instead of the free polycarboxylic acids it is also possible to use the corresponding polycarboxylic anhydrides or the corresponding polycarboxylic esters of lower alcohols or mixtures thereof to produce the polyesterpolyols. The polycarboxylic acids can be aliphatic, cycloaliphatic, araliphatic, aromatic or heterocyclic and may be substituted, for example by halogen atoms, and/or unsaturated. Examples are suberic acid, azelaic acid, phthalic acid, isophthalic acid, phthalic anhydride, tetrahydrophthalic anhydride, hexahydrophthalic anhydride, tetrachlorophthalic anhydride, endomethylene-tetrahydrophthalic anhydride, glutaric anhydride, alkenylsuccinic acid, maleic acid, maleic anhydride, fumaric acid, dimeric fatty acids. Preference is given to dicarboxylic acids of the general formula HOOC—$(CH_2)_y$—COOH, where y is from 1 to 20, preferably an even number from 2 to 20, e.g., succinic acid, adipic acid, dodecanedicarboxylic acid and sebacic acid.

Suitable polyhydric alcohols include for example ethylene glycol, 1,2-propanediol, 1,3-propanediol, 1,3-butanediol, 1,4-butenediol, 1,4-butynediol, 1,5-pentanediol, neopentylglycol, bis(hydroxy-methyl)cyclohexanes such as 1,4-bis(hydroxymethyl)cyclohexane, 2-methylpropane-1,3-diol, methylpentanediols, also diethylene glycol, triethylene glycol, tetraethylene glycol, polyethylene glycol, dipropylene glycol, polypropylene glycol, dibutylene glycol and polybutylene glycols. Preference is given to alcohols of the general formula HO—$(CH_2)_x$—OH, where x is from 1 to 20, preferably an even number from 2 to 20. Examples are ethylene glycol, 1,4-butanediol, 1,6-hexanediol, 1,8-octanediol and 1,12-dodecanediol. Preference is further given to neopentylglycol and 1,5-pentanediol.

It is also possible to use polycarbonatediols as obtainable for example by reacting phosgene with an excess of the low molecular weight alcohols mentioned as formative components for the polyesterpolyols.

It is also possible to use lactone-based polyesterdiols, which are homo- or copolymers of lactones, preferably terminal hydroxyl-functional addition products of lactones with suitable difunctional initiator molecules. Preferred lactones are derived from compounds of the general formula HO—$(CH_2)_z$—COOH, where z is from 1 to 20 and one hydrogen atom of a methylene unit may also be replaced by a $C_1$- to $C_4$-alkyl radical. Examples are epsilon-caprolactone, β-propiolactone, gamma-butyrolactone and/or methyl-epsilon-caprolactone and also mixtures thereof.

Suitable monomers (a2.1) further include polyetherdiols. They are obtainable especially by homopolymerization of ethylene oxide, propylene oxide, butylene oxide, tetrahydrofuran, styrene oxide or epichlorohydrin, for example in the presence of $BF_3$, or by addition of these compounds, optionally mixed or in succession, to initiating components possessing reactive hydrogen atoms, such as alcohols or amines, e.g., water, ethylene glycol, 1,2-propane-diol, 1,3-propanediol, 1,2-bis(4-hydroxydiphenyl) propane or aniline. Particular preference is given to polytetrahydrofuran having a molecular weight from 240 to 5000, especially from 500 to 4500.

The polyols can also be used as mixtures in a ratio within the range from 0.1:1 to 1:9.

The hardness and the modulus of elasticity of the polyurethanes can be increased by using low molecular weight diols (a2.2) having a molecular weight from about 62 to 500, preferably from 62 to 200, g/mol, as diols (a2) as well as diols (a2.1).

Monomers (a2.2) are in particular the short-chain alkanediols mentioned as formative components for the production of polyesterpolyols, preference being given to unbranched diols having from 2 to 12 carbon atoms and an even number of carbon atoms and also to 1,5-pentanediol.

The proportion of said diols (a2.1), based on total diols (a2), is preferably from 10 to 100 mol % and the proportion of said monomers (a2.2), based on the total diols (a2), is from 0 to 90 mol %. Particularly preferably, the ratio of said diols (a2.1) to said monomers (a2.2) is within the range from 0.1:1 to 5:1, particularly preferably within the range from 0.2:1 to 2:1.

To ensure that the polyurethanes are water-dispersible, the polyurethanes are polymerized not only from the components (a1), (a2) and (a4) but also from monomers (a3) which differ from said components (a1), (a2) and (a4) and which bear at least one isocyanate group or at least one isocyanate reactive group and in addition at least one hydrophilic group or a group which is convertible into a hydrophilic group. In what follows, the expression "hydrophilic groups or potentially hydrophilic groups" is abbreviated to "(potentially) hydrophilic groups." The (potentially) hydrophilic groups react significantly slower with isocyanates than the functional groups of the monomers which are used for forming the polymer main chain.

The proportion of components having (potentially) hydrophilic groups among the total amount of components (a1), (a2), (a3) and (a4) is generally determined in such a way that the molar quantity of (potentially) hydrophilic groups is from 30 to 1000, preferably from 50 to 500, particularly preferably from 80 to 300, mmol/kg, based on the weight quantity of all monomers (a1) to (a4).

The (potentially) hydrophilic groups can be nonionic or preferably (potentially) ionic hydrophilic groups.

Nonionic hydrophilic groups are suitably polyalkylene oxide radicals, especially polyethylene glycol ethers comprising preferably from 5 to 100, more preferably from 10 to 80, ethylene oxide repeat units. The level of polyethylene oxide units is generally from 0 to 10%, preferably from 0 to 6%, by weight, based on the weight quantity of all monomers (a1) to (a4).

Preferred monomers having nonionic hydrophilic groups are polyethylene oxide diols, polyethylene oxide monools and also the reaction products of a polyethylene glycol and a diisocyanate which bear a terminally etherified polyethylene glycol radical. Such diisocyanates and processes for making them are described in U.S. Pat. No. 3,905,929 and U.S. Pat. No. 3,920,598.

Ionic hydrophilic groups are in particular anionic groups such as sulfonate, carboxylate and phosphate in the form of their alkali metal or ammonium salts and also cationic groups such as ammonium groups, especially protonated tertiary amino groups or quaternary ammonium groups.

Potentially ionic hydrophilic groups are in particular those which are convertible by simple neutralization, hydrolysis or quaternization reactions into the abovementioned ionic hydrophilic groups, for example carboxylic acid groups, anhydride groups or tertiary amino groups.

(Potentially) ionic monomers (a3) are described at length for example in Ullmanns Encyklopädie der technischen Chemie, 4th edition, volume 19, pages 311–313 and for example in DE-A 1 495 745.

(Potentially) cationic monomers (a3) of particular industrial importance are especially monomers having tertiary amino groups, for example: tris(hydroxyalkyl)amines, N,N'-bis(hydroxyalkyl)-alkylamines, N-hydroxyalkyldialkylamines, tris(aminoalkyl)amines, N,N'-bis(aminoalkyl)alkylamines, N-aminoalkyldialkylamines, wherein the alkyl radicals and alkanediyl units of these tertiary amines independently have from 1 to 6 carbon atoms.

These tertiary amines are converted into the ammonium salts either with acids, preferably strong mineral acids such as phosphoric acid, sulfuric acid, hydrohalic acids or strong organic acids or by reaction with suitable quaternizing agents such as C1- to C6-alkyl halides or benzyl halides, for example bromides or chlorides.

Suitable monomers having (potentially) anionic groups are customarily aliphatic, cycloaliphatic, araliphatic or aromatic carboxylic acids and sulfonic acids which bear at least one alcoholic hydroxyl group or at least one primary or secondary amino group. Preference is given to dihydroxyalkylcarboxylic acids, especially having from 3 to 10 carbon atoms, as also described in U.S. Pat. No. 3,412,054. Preference is given especially to compounds of the general formula

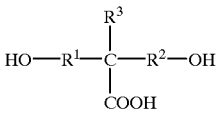

where $R^1$ and $R^2$ are each a $C_1$- to $C_4$-alkanediyl unit and $R^3$ is a $C_1$- to $C_4$-alkyl unit, and especially to dimethylolpropionic acid (DMPA).

Also suitable are corresponding dihydroxysulfonic acids and dihydroxyphosphonic acids such as 2,3-dihydroxypropanephosphonic acid.

It is also possible to use dihydroxy compounds having a molecular weight from more than 500 to 10,000 g/mol and having at least 2 carboxylate groups, which are known from DE-A 3 911 827.

As monomers (a3) having isocyanate reactive amino groups there may be used aminocarboxylic acids such as lysine, β-alanine and the adducts of aliphatic diprimary diamines with a,β-unsaturated carboxylic or sulfonic acids mentioned in DE-A-2034479.

Such compounds conform for example to the formula (a3.1)

$H_2N—R^4—NH—R^5—X$ (a3.1)

where

—$R^4$ and $R^5$ are independently $C_1$- to $C_6$-alkanediyl, preferably ethylene and X is COOH or $SO_3H$.

Particularly preferred compounds of the formula (a3.1) are N-(2-aminoethyl)-2-aminoethanecarboxylic acid and also N-(2-aminoethyl)-2-aminoethanesulfonic acid and also the corresponding alkali metal salts, among which sodium is particularly preferred as counterion.

Particular preference is further given to the adducts of the abovementioned aliphatic diprimary diamines with 2-acrylamido-2-methylpropanesulfonic acid as described for example in D 1 954 090.

If monomers having potentially ionic groups are used, they may be converted into the ionic form before, during, but preferably after the isocyanate polyaddition, since ionic monomers are frequently very slow to dissolve in the reaction mixture. The sulfonate or carboxylate groups are particularly preferably present in the form of their salts with an alkali metal ion or an ammonium ion as counterion.

The monomers (a4), which differ from the monomers (a1) to (a3), generally serve the purpose of crosslinking or of chain extension. They are generally more than dihydric nonphenolic alcohols, amines having 2 or more primary and/or secondary amino groups and also compounds which, as well as one or more alcoholic hydroxyl groups, bear one or more primary and/or secondary amino groups.

Polyamines having 2 or more primary and/or secondary amino groups are used especially when chain extension or crosslinking is to take place in the presence of water, since amines are generally faster than alcohols or water when it comes to reacting with isocyanates. This is frequently necessary when aqueous dispersions of crosslinked polyurethanes or polyurethanes of high molecular weight are desired. In such cases, prepolymers having isocyanate groups are prepared, rapidly dispersed in water and then chain-extended or crosslinked by addition of compounds having a plurality of isocyanate reactive amino groups.

Suitable amines for this purpose are generally polyfunctional amines of a molecular weight from 32 to 500 g/mol, preferably from 60 to 300 g/mol, which contain at least 2 amino groups selected from the group consisting of primary and secondary amino groups. Examples are diamines such as diaminoethane, diamino-propanes, diaminobutanes, diaminohexanes, piperazine, 2,5-dimethylpiperazine, amino-3-aminomethyl-3,5,5-trimethylcyclohexane (isophoronediamine, IPDA), 4,4'-diaminodicyclohexylmethane, 1,4-diaminocyclohexane, aminoethylethanolamine, hydrazine, hydrazine hydrate or triamines such as diethylene-triamine or 1,8-diamino-4-aminomethyloctane.

The amines may also be used in blocked form, for example in the form of the corresponding ketimines (see for example CA-1 129 128), ketazines (cf. for example U.S. Pat. No. 4,269,748) or amine salts (see U.S. Pat. No. 4,292,226).

Preference is given to mixtures of di- and triamines, particular preference being given to mixtures of isophoronediamine and diethylenetriamine.

The polyurethanes contain preferably no polyamine or from 1 to 20, particularly preferably from 4 to 15, mol %, based on the total amount of components (a2) and (a4), of a polyamine having at least 2 isocyanate reactive amino groups as monomers (a4).

Alcohols which have a higher hydricness than two and which may be used for inserting a certain degree of branching or crosslinking include for example trimethylolpropane, glycerol or sugar.

For the same purpose it is also possible to use monomers (a4) which are isocyanates having a functionality of more than two. Commercially available compounds include for example the isocyanurate or the biuret of hexamethylene diisocyanate.

Monomers (a5), the use of which is optional, are monoisocyanates, monoalcohols and primary and secondary monoamines. In general, their proportion does not exceed 10 mol %, based on the total molar quantity of the monomers. These monofunctional compounds customarily bear further functional groups such as olefinic groups or carbonyl groups and are used for incorporating functional groups into the polyurethane which render the dispersing or crosslinking or further polymer-analogous reaction of the polyurethane possible. Suitable for this purpose are monomers such as isopropenyl-a,a-dimethylbenzyl isocyanate (TMI) and esters of acrylic or methacrylic acid such as hydroxyethyl acrylate or hydroxyethyl methacrylate.

It is common knowledge in the field of polyurethane chemistry how the molecular weight of the polyurethanes can be adjusted through choice of the proportions of mutually reactive monomers and the arithmetic mean of the number of reactive functional groups per molecule.

The components (a1), (a2), (a3) and (a4) and their respective molar quantities are normally chosen so that the ratio A:B, where A) is the molar amount of isocyanate groups, and B) is the sum total of the molar quantity of the hydroxyl groups and the molar quantity of the functional groups capable of reacting with isocyanates in an addition reaction, is within the range from 0.5:1 to 2:1, preferably within the range from 0.8:1 to 1.5, particularly preferably within the range from 0.9:1 to 1.2:1. The A:B ratio is most preferably very close to 1:1.

As well as components (a1), (a2), (a3) and (a4), monomers having only one reactive group are generally used in amounts of up to 15 mol %, preferably up to 8 mol %, based on the total amount of components (a1), (a2), (a3) and (a4).

The monomers (a1) to (a4) used on average bear customarily from 1.5 to 2.5, preferably from 1.9 to 2.1, particularly preferably 2.0, isocyanate groups or functional groups capable of reacting with isocyanates in an addition reaction.

The polyaddition of components (a1) to (a4) is generally effected according to the known processes, preferably by the "acetone process" or the "prepolymer mixing process," which are described for example in DE-A-4418157.

The general procedure is first to prepare a prepolymer or the polyurethane (a) in an inert organic solvent and then to disperse the prepolymer or the polyurethane (a) in water. In the case of the prepolymer, the conversion to the polyurethane (a) is effected by reaction with the water or by a subsequently added amine (component a4). The solvent is customarily completely or partially distilled off after the dispersing.

The dispersions generally have a solids content from 10 to 75%, preferably from 20 to 65%, by weight and a viscosity from 10 to 500 mPas (measured at 20° C. and a shear rate of 250 s−1).

Hydrophobic assistants, which may be difficult to disburse homogeneously in the finished dispersion, for example phenol condensation resins formed from aldehydes and phenol or phenol derivatives or epoxy resins and further polymers, described for example in DE-A-3903538, 43 09 079 and 40 24 567, which are used, as adhesion improvers, for example, in polyurethane dispersions, can be added to the polyurethane or the prepolymer even prior to the dispersing according to the three abovementioned references.

The polyurethane dispersions may comprise up to 40%, preferably up to 20%, by weight of other polymers (B) in dispersed form, based on their solids content. Such polyurethane dispersions are generally prepared by admixture with dispersions comprising said polymers (B). However, the polyurethane dispersions are preferably free from effective amounts of other polymers.

Suitable polymers (B) further include polymers prepared by free-radically initiated polymerization. They are customarily polymerized from b1) from 30 to 100 parts by weight of at least one monomer selected from the group consisting of $C_1$- to $C_{20}$-alkyl (meth)acrylates, vinyl esters of unsaturated carboxylic acids having from 3 up to 20 carbon atoms, ethylenically unsaturated nitrites, aromatic vinyl compounds having up to 20 carbon atoms, vinyl halides and aliphatic hydrocarbons having from 2 to 8 carbon atoms and 1 or 2 double bonds (monomers b1), and b2) from 0 to 70 parts by weight of other compounds I (monomers b2) having at least one ethylenically unsaturated group.

(Meth)acryl is short for methacryl or acryl.

Examples of suitable monomers (b1) are (meth)acrylic alkyl esters having a $C_1$–$C_{10}$-alkyl radical, such as methyl methacrylate, methyl acrylate, n-butyl acrylate, ethyl acrylate and 2-ethylhexyl acrylate, and also acrylic or methacrylic acid.

More particularly, mixtures of (meth)acrylic alkyl esters are also suitable.

Examples of vinyl esters of carboxylic acids having from 1 to 20 carbon atoms are vinyl laurate, vinyl stearate, vinyl propionate and vinyl acetate.

Suitable aromatic vinyl compounds are vinyltoluene, alpha- and p-methylstyrene, alpha-butylstyrene, 4-n-butylstyrene, 4-n-decylstyrene and preferably styrene.

Examples of nitriles are acrylonitrile and methacrylonitrile.

Vinyl halides are chlorine-, fluorine- or bromine-substituted ethylenically unsaturated compounds, preferably vinyl chloride and vinylidene chloride.

Suitable nonaromatic hydrocarbons having from 2 to 8 carbon atoms and one or two olefinic double bonds are butadiene, isoprene and chloroprene and also ethylene, propylene and isobutylene.

The main monomers are preferably also used mixed.

Aromatic vinyl compounds such as styrene are for example frequently used mixed with $C_1$–$C_{20}$-alkyl (meth) acrylates, especially with $C_1$–$C_8$-alkyl (meth)acrylates, or nonaromatic hydrocarbons such as isoprene or preferably butadiene.

Suitable monomers (b2) are esters of acrylic and methacrylic acid with alcohols having from 1 to 20 carbon atoms which, as well as the oxygen atom in the alcohol group, contain at least one further heteroatom and/or which contain an aliphatic or aromatic ring, such as 2-ethoxyethyl acrylate, 2-butoxyethyl (meth)acrylate, dimethylaminoethyl (meth) acrylate, diethyl-aminoethyl (meth)acrylate, (meth)acrylic aryl, alkaryl or cycloalkyl esters, such as cyclohexyl (meth) acrylate, phenylethyl (meth)acrylate, phenylpropyl (meth) acrylate or acrylic esters of heterocyclic alcohols such as furfuryl (meth)acrylate.

It is further possible to use monomers having amino or amide groups such as (meth)acrylamide and also their derivatives having $C_1$–$C_4$-akyl substitution on the nitrogen.

Of importance are especially hydroxyl-functional monomers, for example (meth)acrylic $C_1$–$C_{15}$-alkyl esters which are substituted by one or two hydroxyl groups. Hydroxyl-functional comonomers of particular importance are (meth)acrylic $C_2$–$C_8$-hydroxyalkyl esters, such as n-hydroxyethyl, n-hydroxypropyl or n-hydroxybutyl (meth) acrylate.

It is frequently advisable to include monomers having carboxylic acid or carboxylic anhydride groups, for example acrylic acid, methacrylic acid, itaconic acid, maleic anhydride; these monomers are used in amounts which are preferably within the range from 0 to 10% by weight, particularly preferably within the range from 0.1 to 3% by weight, based on the copolymer.

The copolymer is prepared by free-radical polymerization. Suitable methods of polymerization, such as bulk, solution, suspension or emulsion polymerization, are known to the person skilled in the art.

Preferably, the copolymer is prepared by solution polymerization with subsequent dispersing in water or particularly preferably by emulsion polymerization.

In the case of an emulsion polymerization the comonomers can be polymerized as usual in the presence of a water-soluble initiator and of an emulsifier at preferably from 30 to 95° C.

Examples of suitable initiators are sodium persulfate, potassium persulfate, ammonium persulfate, peroxides such as, for example, tert-butyl hydroperoxide, water-soluble azo compounds or else redox initiators.

Examples of emulsifiers used are alkali metal salts of long-chain fatty acids, alkyl sulfates, alkylsulfonates, alkylated arylsulfonates or alkylated biphenyl ether sulfonates. Further suitable emulsifiers are reaction products of alkylene oxides, especially ethylene oxide or propylene oxide, with fatty alcohols, fatty acids or phenol/alkylphenols.

In the case of aqueous secondary dispersions the copolymer is first prepared by solution polymerization in an organic solvent and then dispersed in water by addition of salt-formers, for example ammonia, to give carboxyl-containing copolymers without the use of an emulsifier or dispersing assistant. The organic solvent can be removed by distillation. The preparation of aqueous secondary dispersions is known to the person skilled in the art and is described in DE-A-37 20 860, for example.

To control the molecular weight it is possible to employ regulators in the polymerization. Suitable examples are SH-containing compounds such as mercaptoethanol, mercapto-propanol, thiophenol, thioglycerol, ethyl thioglycolate, methyl thioglycolate and tert-dodecyl mercaptan. They can be employed for example in amounts from 0 to 0.5% by weight, based on the copolymer.

The nature and amount of the comonomers is preferably chosen so that the resulting copolymer has a glass transition temperature within the range from −60 to +140° C., preferably within the range from −60 to +100° C. The glass transition temperature of the copolymer is measured by differential thermoanalysis or differential scanning calorimetry in accordance with ASTM 3418/82.

The number average molecular weight $M_n$ is preferably within the range from $10^3$ to $5\times10^6$, particularly preferably within the range from $10^5$ to $2\times10^6$ g/mol (measured by gel permeation chromatography using polystyrene as standard).

The polyurethane dispersions may comprise commercially available auxiliary and additive substances such as blowing agents, defoamers, emulsifiers, thickeners and thixotropicizers, colorants such as dyes and pigments.

The polyurethane dispersions customarily comprise less than 10%, particularly preferably less than 0.5%, by weight of organic solvents.

The impregnates formed from the textile sheet materials and the polyurethane dispersions are generally produced by applying the polyurethane dispersions in a conventional manner. Particularly suitable application methods are spraying, dipping, knife-coating, brushing and pad-mangling.

To produce the impregnate, the amount of polyurethane dispersion applied, based on its solids content, is generally within the range from 20 to 100%, preferably within the range from 30 to 50%, by weight, based on the weight of the textile sheet material.

Application is followed by drying, preferably at from 20 to 150° C.

Coating weights and processes are generally chosen so that the polyurethane dispersion seals up virtually every pore in the textile sheet material.

To produce the poromeric synthetic leathers, the impregnates are subjected to the action of an aqueous solution of a Brønsted base.

Suitable Brønsted bases preferably have a $pK_B$ of not more than 5.

Examples of suitable Brønsted bases are alkali metal hydroxides, carbonates and bicarbonates, ammonia, amines, which may also be used mixed, if desired. Particular preference is given to sodium hydroxide.

The aqueous solutions contain in general from 1 to 40%, preferably from 2 to 10%, by weight of the Brønsted bases.

The temperature of the aqueous solutions which are allowed to act on the impregnates is customarily within the range from 0 to 120° C., preferably within the range from 20 to 100° C.

The treatment time is generally within the range from 1 to 300 min, preferably within the range from 1 to 120 min.

From 20 to 1000 parts, preferably from 100 to 300 parts, of an aqueous solution of the base are used per one part of impregnated textile.

The impregnates are advantageously subjected to the action of the aqueous solutions by completely wetting them with a spray of the aqueous solutions or by dipping them into the aqueous solutions.

Increasing treatment time, temperature and Brønsted base concentration in the aqueous solution endows the poromeric synthetic leathers with a softer hand and a rougher surface.

It is believed that the action of the aqueous solutions brings about the formation of micropores in the impregnates. This is because, in general, the impregnates possess virtually no water vapor permeability, as measured by German standard specification DIN 53333, whereas the poromeric synthetic leathers have a water vapor permeability of more than 1, customarily from 1 to 10, mg/hcm2.

Following the action of the aqueous solution, the Brønsted base is removed, for example by washing the poromeric synthetic leathers with water. Thereafter the poromeric synthetic leathers are usually dried.

Depending on the intended application, the poromeric synthetic leathers can subsequently be further treated or aftertreated similarly to natural leathers, for example by brushing, filling, milling or ironing.

If desired, the poromeric synthetic leathers may (like natural leather) be finished with the customary finishing compositions. This provides further possibilities for controlling their character.

The poromeric leathers are in principle useful for all applications in which natural leathers are used; more particularly, they can be used in place of suede leather.

EXAMPLES

Experimental part Production of poromeric synthetic leathers Polyurethane dispersion used The PUR dispersion used was EmuldurÒ DS 2299 (BASF AG). Emuldur DS 2299 is an aliphatic polyester urethane dispersion having a solids content of 40%. Textile sheet materials used Two different PES needlefelt nonwovens were used as base material.

Needlefelt A: about 300 g/m$^2$ (comparatively lightly needled material)

Needlefelt B: about 450 g/m$^2$ (comparatively densely needled material) Production sequence/method:

Both the base nonwovens were impregnated with the dispersion by pad-mangling and then dried at 130° C. for 3 minutes.

| Example | Needlefelt | Solids add-on |
|---|---|---|
| 1 | A | 30% |
| 2 | A | 40% |
| 3 | B | 30% |
| 4 | B | 40% |

The dried nonwovens were subsequently treated with 5% strength aqueous sodium hydroxide solution at 90° C. by continuous slow stirring.

The nonwovens were removed from the sodium hydroxide solution after 15, 30, 45 or 60 min., washed off and dried.

The articles obtained resemble suede leather and have a pleasant soft hand and high tensile strength.

Using a base nonwoven of higher basis weight and a higher coating weight made the articles firmer and harsher.

Increasing the treatment time endowed the articles with a softer hand and a rougher surface.

We claim:

1. A process for producing poromeric synthetic leather, which comprises:

(A) impregnating a textile sheet material with an aqueous polyurethane dispersion and drying, to produce an essentially nonporous impregnate;

(B) subjecting said impregnate to the action of an aqueous solution of a Brønsted base, to produce a poromeric synthetic leather; and (C) removing said aqueous solution of said Brønsted base from said poromeric synthetic leather, wherein said textile sheet material is a polyester textile sheet material.

2. The process of claim 1, wherein said textile sheet material is a nonwoven polyester fabric having a basis weight of from 100 to 1000 g/m2.

3. The process of claim 1, wherein said aqueous polyurethane dispersion used comprises a polyurethane bearing ionic and/or nonionic hydrophilic groups.

4. The process of claim 1, wherein said polyurethane is prepared by polymerizing monomers, said monomers comprising:

a1) a diisocyanate having from 4 to 30 carbon atoms;

a2) a diol component, wherein said diol component comprises:

a2.1) from 10 to 100 mol %, based on the total moles of said diol component (a2), of a diol having a molecular weight from 500 to 5000, and a2.2) from 0 to 90 mol %, based on total moles of said diol component (a2), of a diol having a molecular weight from 60 to 500 g/mol;

a3) a monomer, other than monomers (a1) and (a2), which bears at least one isocyanate group or at least one isocyanate reactive group and which in addition bear at least one hydrophilic group or a potentially hydrophilic group to render the polyurethanes water-dispersible;

a4) optionally further polyfunctional compounds, another than monomer (a1), (a2), and (a3), having reactive groups comprising alcoholic hydroxyl groups, primary or secondary amino groups or isocyanate groups; and a5) optionally a monofunctional compound, other than monomers (a1), (a2), (a3), and (a4), having a reactive group comprising an alcoholic hydroxyl group, a primary or secondary amino group or an isocyanate group.

5. The process of claim 1, wherein said aqueous polyurethane dispersion comprises up to 40% by weight, based on the solids content of the polyurethane, of a polymer B, wherein said polymer B is prepared by free-radically initiated polymerization of monomers, said monomers comprising:

b1) from 30 to 100 parts by weight of at least one monomer selected from the group consisting of C1- to C20-alkyl (meth)acrylates, vinyl esters of unsaturated carboxylic acids having from 3 up to 20 carbon atoms, ethylenically unsaturated nitrites, aromatic vinyl compounds having up to 20 carbon atoms, vinyl halides and aliphatic hydrocarbons having from 2 to 8 carbon atoms and 1 or 2 double bonds (monomers b1); and b2) from 0 to 70 parts by weight of other compounds having at least one ethylenically unsaturated group.

6. The process of claim 1, wherein said impregnate is produced by contacting said textile sheet material with from 20 to 100% by weight, based on the weight of said textile sheet material, of said polyurethane dispersion, based on its solids content.

7. The process of claim 1, wherein said Brønsted base has a pKb of not more than 5.

8. The process of claim 1, wherein said Brønsted base is selected from alkali metal hydroxides, alkali metal carbonates, alkali metal bicarbonates, ammonia, amines, and mixtures thereof.

9. The process of claim 1, wherein said impregnate is subjected to the action of an aqueous solution comprising from 2 to 10% by weight of said Brønsted base at a temperature of 20° C. to 100° C. for a time of 1 minute to 300 minutes.

10. The process of claim 1, wherein said removing of said aqueous solution of said Brønsted base from said poromeric synthetic leather is carried out by washing said poromeric synthetic leather with water and drying.

11. A poromeric synthetic leather, prepared by a processes, wherein said process comprises:

(A) impregnating a textile sheet material with an aqueous polyurethane dispersion and drying, to produce an essentially nonporous impregnate;

(B) subjecting said impregnate to the action of an aqueous solution of a Brønsted base, to produce a poromeric synthetic leather; and (C) removing said aqueous solution of said Brønsted base from said poromeric synthetic leather, wherein said textile sheet material is a polyester textile sheet material.

12. The poromeric synthetic leather of claim 11, wherein said textile sheet material is a nonwoven polyester fabric having a basis weight of from 100 to 1000 g/m2.

13. The poromeric synthetic leather of claim 11, wherein said aqueous polyurethane dispersion used comprises a polyurethane bearing ionic and/or nonionic hydrophilic groups.

14. The poromeric synthetic leather of claim 11, wherein said polyurethane is prepared by polymerizing monomers, said monomers comprising:

a1) a diisocyanate having from 4 to 30 carbon atoms;

a2) a diol component, wherein said diol component comprises:

a2.1) from 10 to 100 mol %, based on the total moles of said diol component (a2), of a diol having a molecular weight from 500 to 5000, and a2.2) from 0 to 90 mol %, based on total moles of said diol component (a2), of a diol having a molecular weight from 60 to 500 g/mol;

a3) a monomer, other than monomers (a1) and (a2), which bears at least one isocyanate group or at least one isocyanate reactive group and which in addition bear at least one hydrophilic group or a potentially hydrophilic group to render the polyurethanes water-dispersible;

a4) optionally further polyfunctional compounds, another than monomer (a1), (a2), and (a3), having reactive groups comprising alcoholic hydroxyl groups, primary or secondary amino groups or isocyanate groups; and a5) optionally a monofunctional compound, other than monomers (a1), (a2), (a3), and (a4), having a reactive group comprising an alcoholic hydroxyl group, a primary or secondary amino group or an isocyanate group.

15. The poromeric synthetic leather of claim 11, wherein said aqueous polyurethane dispersion comprises up to 40% by weight, based on the solids content of the polyurethane, of a polymer B, wherein said polymer B is prepared by free-radically initiated polymerization of monomers, said monomers comprising:

b1) from 30 to 100 parts by weight of at least one monomer selected from the group consisting of C1- to C20-alkyl (meth)acrylates, vinyl esters of unsaturated carboxylic acids having from 3 up to 20 carbon atoms, ethylenically unsaturated nitriles, aromatic vinyl compounds having up to 20 carbon atoms, vinyl halides and aliphatic hydrocarbons having from 2 to 8 carbon atoms and 1 or 2 double bonds (monomers b1); and b2) from 0 to 70 parts by weight of other compounds having at least one ethylenically unsaturated group.

16. The poromeric synthetic leather of claim 11, wherein said impregnate is produced by contacting said textile sheet material with from 20 to 100% by weight, based on the weight of said textile sheet material, of said polyurethane dispersion, based on its solids content.

17. The poromeric synthetic leather of claim 11, wherein said Brønsted base has a pKb of not more than 5.

18. The poromeric synthetic leather of claim 11, wherein said Brønsted base is selected from alkali metal hydroxides, alkali metal carbonates, alkali metal bicarbonates, ammonia, amines, and mixtures thereof.

19. The poromeric synthetic leather of claim 11, wherein said impregnate is subjected to the action of an aqueous solution comprising from 2 to 10% by weight of said Brønsted base at a temperature of 20° C. to 100° C. for a time of 1 minute to 300 minutes.

20. The poromeric synthetic leather of claim 11, wherein said removing of said aqueous solution of said Brønsted base from said poromeric synthetic leather is carried out by washing said poromeric synthetic leather with water and drying.

* * * * *